United States Patent [19]

Sutton

[11] Patent Number: 4,902,169

[45] Date of Patent: Feb. 20, 1990

[54] JACK-UP TYPE PLATFORM INCLUDING ADJUSTABLE STOP ASSEMBLY

[76] Inventor: John R. Sutton, P.O. Box 32, Beaumont, Tex. 77704

[21] Appl. No.: 353,253

[22] Filed: May 17, 1989

[51] Int. Cl.[4] ..... E02B 17/00; E02D 25/00

[52] U.S. Cl. ..... 405/204; 405/196; 405/198

[58] Field of Search ..... 405/204, 203, 195, 196, 405/198, 208, 209, 224, 227, 225

[56] References Cited

U.S. PATENT DOCUMENTS

| | | | |
|---|---|---|---|
| 2,862,738 | 12/1958 | Bayley | 405/198 X |
| 2,900,794 | 8/1959 | Sutton | 405/204 |
| 4,662,788 | 5/1987 | Kypke et al. | 405/204 |
| 4,666,340 | 5/1987 | Cox | 405/204 |
| 4,723,875 | 2/1988 | Sutton | 405/204 |
| 4,761,097 | 8/1988 | Turner | 405/204 |

*Primary Examiner*—Dennis L. Taylor

*Attorney, Agent, or Firm*—Burns, Doane, Swecker & Mathis

[57] ABSTRACT

A marine structure which includes a jack-up platform assembly having a platform and at least three support legs, each leg having a generally cylindrical adapter at a lower end thereof. A support assembly includes a receptacle for each of the support legs, the receptacle mating with the support leg adapter and supporting the platform assembly, enabling the platform to be jacked up above an ocean surface. A stop assembly is removably attached to each of the support legs, the stop assembly being spaced from the support leg adapter and including a stationary part which mechanically engages a portion of the receptacle when the support leg adapter penetrates a predetermined distance into the receptacle. The stop assembly is secured to the receptacle by pins extending through a part of the stop assembly and a part of the receptacle. The stationary part can be a cover attached to the support leg by racks engaging racks at the corners of the support leg or a horizontally extending annular base secured around the support leg by a framework including racks engaging the racks at the corners of the support leg.

20 Claims, 10 Drawing Sheets

205
240
244
244
244
243
251
222
229
228
224a 205
240
244
244
244
251
250
222
229
228
224c 205
240
226
242
227
240
222
228
224b 245
205c
240
224c 205b
240
224b 240
205a
224a

JACK-UP TYPE PLATFORM INCLUDING ADJUSTABLE STOP ASSEMBLY

BACKGROUND OF THE INVENTION

1. Field of the Invention

The present invention relates generally to marine structures and specifically to a deep water support assembly for a jack-up type platform structure.

2. Description of Related Art

Conventional jack-up marine structures are commonly used in off-shore oil drilling and production operations in water depths of between 250 to 450 feet. A typical jack-up type structure comprises a platform which serves as a barge for transporting the structure to a worksite. Legs are provided at corners of the platform and are movable relative to the platform in a vertical direction.

Construction of a typical jack-up type structure is carried out on dry land. Once the structure is completed, it is floated to a worksite and the legs lowered to the marine floor where they are anchored by pilings driven through pile guides in the bases of the legs and into the marine floor. Thereafter, the platform is raised above the marine surface by jacking-up the platform vertically on the legs to a desired height above the marine surface to provide an air gap of 50 to 100 feet. This jacking-up of the platform is normally carried out with a jacking mechanism which operates through any known transmission arrangement connecting the legs to the platform. This construction of the typical jack-up structure permits the entire completed structure to be floated to the worksite, thereby reducing both the cost of building the structure and the time needed to assemble the structure at the worksite.

In view of this need for deep water structures and in view of the success of the already existing jack-up technology, it can be understood that there exists a need for a structure which can be employed in deep water but which takes advantage of the time and cost benefits of known jack-up type structures. In addition, since there exists a significant number of already constructed jack-up type structures that are lying idle due to (a) economic conditions and (b) a drop in demand for platforms limited to use in water depths of between 250 and 450 feet, it is desired to find a way to extend the utility of the structures to enable their use in deeper water. This extension of utility could represent a significant savings in the cost of a complete deep water system.

Applicant's prior U.S. Pat. No. 4,723,875 discloses a system which employs already constructed jack-up structures in water depths far exceeding the depths for which the structures were originally designed. In particular, this patent describes a support assembly which includes a tower assembly having a support base, pilings which are driven through pile guides in the support base for anchoring the support base to the marine floor, receptacles on the upper end of the tower assembly for receiving the legs of the jack-up structure and pneumatic gripper rings between the jack-up legs and the walls of the receptacles.

The tower assembly is constructed while on land and in a vertical orientation and the support base is designed to serve as barge for floating the tower assembly to a worksite while it is maintained in the vertically upright position. The assembly can be partially submerged during its transportation to the worksite so as to stabilize the assembly during travel. When the assembly is roughly over the worksite, controlled flooding of the assembly causes it to sink to the marine floor. The assembly is then anchored to the marine floor by the pilings and after the jack-up structure is floated to the site and positioned over the assembly, the legs of the structure are lowered into the holes of the receptacles. Grouting material is poured into the holes around the legs of the jack-up structure so that the structure is securely anchored on the support assembly. The pneumatic gripper rings provide additional anchoring of the jack-up structure on the support assembly.

The support tower typically has tube columns vertically extending between each receptacle and the support base so as to provide adequate vertical rigidity to the receptacles and support the heavy loads experienced by jack-up type rig structures. The entire assembly can be moved from jobsite to jobsite by removing the piles which anchor the support assembly to the marine floor. Such reusability increases the value of each assembly by extending its potential useful life. The support assembly can have a vertical height of 350 feet and a jack-up assembly designed for use in 150 feet of water provides a marine structure which is usable in a water depth of 500 feet. In addition, a 1,400-foot support assembly could be used with a jack-up assembly designed for use in a 300-foot depth field to provide a marine structure which is usable in a 1,700-foot depth field.

SUMMARY OF THE INVENTION

The present invention provides an alternative to the pneumatic grippers disclosed in U.S. Pat. No. 4,723,875. In particular, the present invention provides an alternate connector means for mating the legs of a jack-up platform assembly to a deep water support assembly.

The alternate connector means of the present invention is useable with a jack-up platform assembly having at least three legs. In particular, the alternate connector means can be provided in sections with each section being attached to a respective leg of the platform. Thus, with each section of the connector means attached to a respective leg, the sections are connected together to form a complete collar around the leg at a fixed height above the bottom end of the leg. This can be done without disturbing the existing structure of the legs.

The legs of the platform are mated with support tower receptacles located 100 to 300 feet below the water surface. That is, with the tower firmly attached by piles to the sea floor, the jack-up type platform is floated above the tower, each leg of the platform (which can be painted with a bright color) is then lowered to close proximity to a respective tower receptacle (the legs being guided by videocamera or by divers), heavy mud is pumped into the respective leg receptacles to cushion the contact of leg ends on the bottom of the tower receptacles, the legs are guided into mating position with the tower receptacles and the legs are fixed in the tower receptacles with the connector means according to the present invention. The large size of the receptacles makes an easy target for the bottom of the legs to be guided into.

The connector means according to the present invention comprises a stop assembly removably attached to each of the support legs, the stop assembly being spaced from a support leg adapter located at the lower end of each respective leg. The stop assembly includes a stationary part which mechanically engages a portion of the receptacle when the support leg adapter penetrates a predetermined distance into the receptacle. The connector means of the present invention also includes securing means for securing the stop assembly to the receptacle.

The support legs typically have racks extending along the length thereof. The stop assembly includes at least one projection adapted to engage a tooth of one of such racks on the support legs. In the preferred embodiment, the stop assembly includes a rack located at each corner of and engaging each rack of a respective support leg. Each rack of the stop assembly is clamped to a respective rack of the support leg.

In one embodiment, the stop assembly includes a cover removably fitted over a respective receptacle and the cover is secured to the stop assembly racks. The cover can comprise sections removably fitted together to form a collar around the support leg at a fixed height above the leg's bottom end. The securing means can comprise at least one part on the stop assembly having an opening therethrough, at least one member on the receptacle having an opening therethrough aligned with the opening in the part when the stop assembly is engaged with the receptacle, and pin means fitted in the opening of the part and the opening of the member for securing the stop assembly to the receptacle.

In another embodiment, the stop assembly includes a base fitted over an upper end of the receptacle, the base including at least one opening cooperating with the securing means to secure the stop assembly to the receptacle. In particular, the at least one opening can comprise a plurality of openings circumferentially spaced apart around the base and the securing means can include a plurality of projections extending from the receptacle and received within the openings when the stop assembly is engaged with the receptacle. In this case, the projections include openings therein and the securing means includes pins inserted in the openings for securing the base between the pins and the upper end of the receptacle.

As with the first embodiment, the base can comprise a plurality of sections removably fitted together. For instance, the sections can be fitted together by hinged connection means which provides joints between adjoining sections of the base. Furthermore, the stop assembly can include a framework connected to the base, the framework including a plurality of vertically extending posts, each of the posts being adjacent a respective corner of the support leg, the stop assembly including racks, each of which extends along a respective one of the posts and a respective one of the support leg jacks.

The framework can include corner pieces, each of which is supported on an upper end of a respective one of the posts and the framework includes horizontally extending connectors, each of which is removably attached to two of the corner pieces. The clamping means for clamping the stop assembly to the support leg racks can comprise a plurality of bands, each of which extends around a leg rack engaged with a rack of the stop assembly, the bands being removably fixed together by bolt means.

If the support leg includes four corners, the base can comprise eight sections, four of the sections being interchangable corner sections with each of the corner sections being disposed at a respective one of the corners of the support leg and another four of the sections being interchangable connecting sections, each of which is between two of the corner sections. The joints between the corner sections and the connecting sections on opposite sides of the support leg can be parallel to each other and the corner sections can have a first edge joined to one of the connecting sections and a second edge joined to another one of the connecting sections such that the first edge extends in a direction which is perpendicular to a direction in which the second edge extends.

BRIEF DESCRIPTION OF THE DRAWINGS

The many advantages and objects achieved by the invention can be seen and understood through consideration of preferred embodiments of the invention which are discussed in the following detailed description which should be considered in connection with the figures in the accompanying drawings wherein like reference numerals are applied to like elements and wherein.

DETAILED DESCRIPTION OF THE PREFERRED EMBODIMENTS

The stop assembly of the present invention is useable with a marine structure such as that disclosed in U.S. Pat. No. 4,723,875, the disclosure of which is hereby incorporated herein. However, the stop assembly of the present invention replaces the pneumatic gripper rings 78, 80 and collar 82 of this patent, the inventor of which is the same as the present invention.

Figure 1:
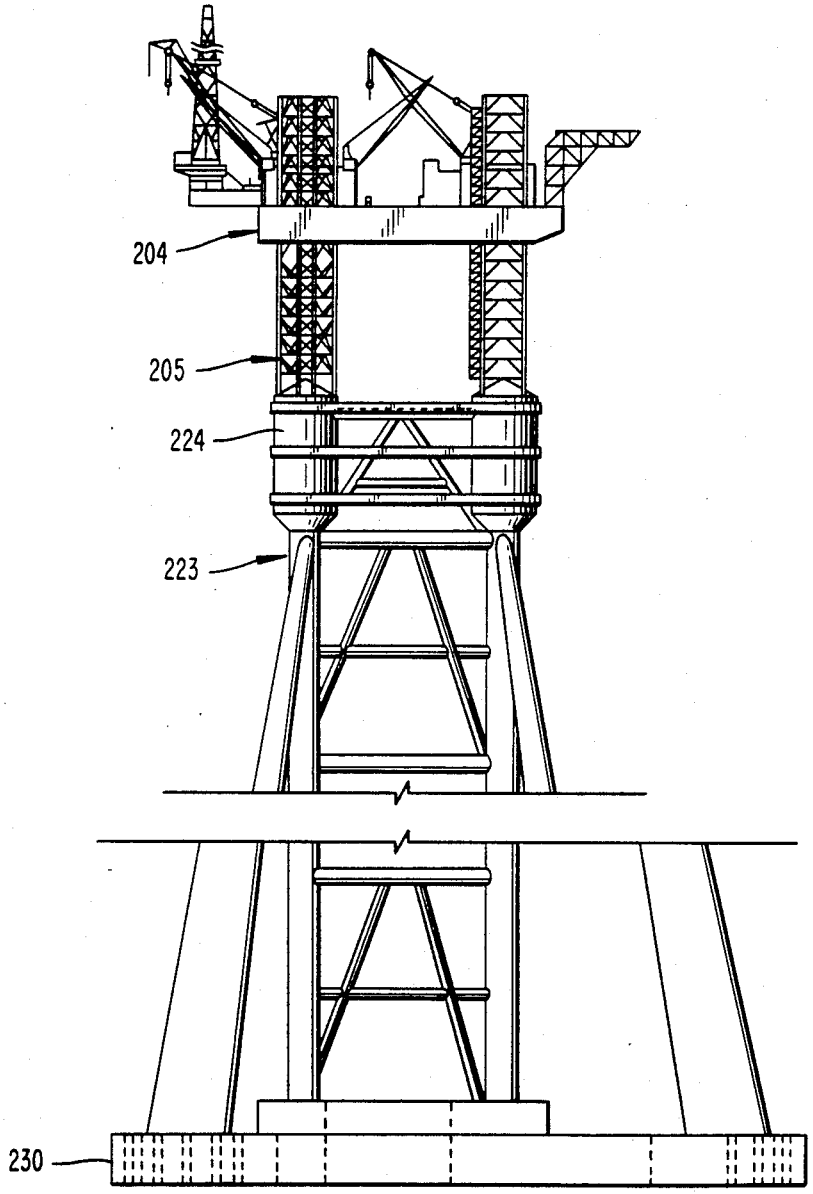
FIG. 1 shows a side elevation of the support structure according to the present invention.

As shown in FIG. 1, the marine structure of the present invention comprises a jack-up platform assembly having a platform 204 and at least three support legs 205, a support assembly 223 including a receptacle 224 for each of the support legs, that is, each of the receptacles includes a receptacle hole for holding a bottom end of a respective support leg. Anchoring means 230 is provided for anchoring a support assembly at a desired location with the receptacles at a fixed height above an ocean floor.

A stop assembly 240 is attached to each of the support legs, the stop assembly being spaced from a generally cylindrical support leg adapter 222 located at a lower end of each of the support legs 205. The stop assembly includes a stationary part which mechanically engages a portion of the receptacle when the support leg adapter 222 penetrates a predetermined distance into the receptacle 224. Securing means 250 is provided for securing the stop assembly 240 to the receptacle 224.

Figure 2:
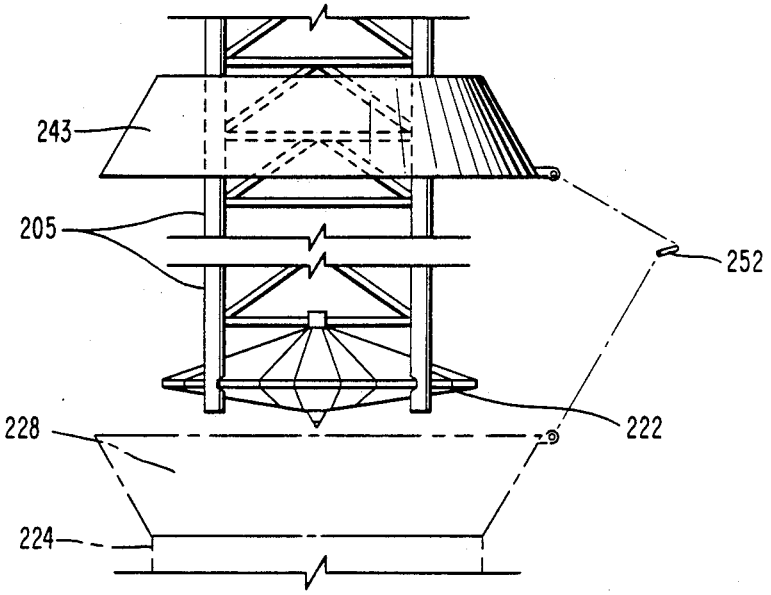
FIG. 2 shows a side elevation of a stop assembly according to a first embodiment of the invention.
Figure 3:
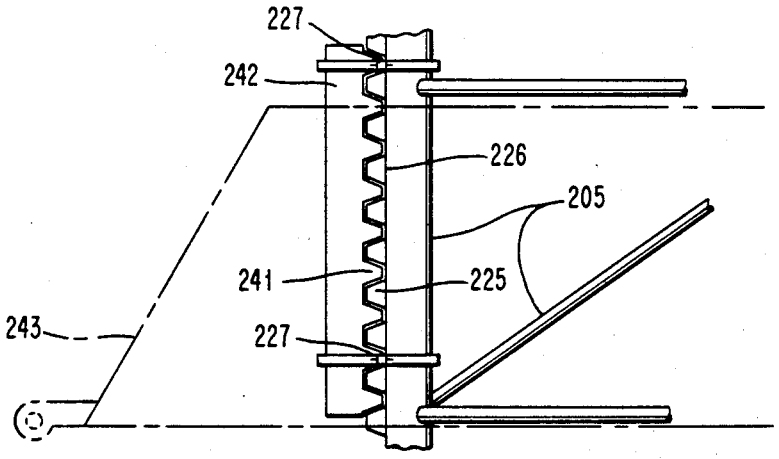
FIG. 3 is a sectional view of the stop assembly shown in FIG. 2.

The first embodiment of the invention will now be described with reference to FIGS. 2–8. As shown in FIG. 2, each of the support legs 205 includes at least one projection 225 along an outer periphery thereof, the at least one projection comprising teeth of a rack 226 extending along a respective vertically extending corner of the support leg 205. The stop assembly includes at least one projection 241 engaged with the projection of a respective one of the support legs, the at least one projection of the stop assembly comprising teeth of a rack 242 interlocking with the teeth of the support leg rack 226. As shown in FIG. 3, the stop assembly includes clamping means 227 for clamping the stop assembly rack 242 to the support leg rack 226, the clamping means 227 comprising, for example, bands extending around the stop assembly rack 242 and the vertically extending column forming a corner of the support leg 205 with the bands being held together by suitable bolt means or other expedient.

Figure 4:
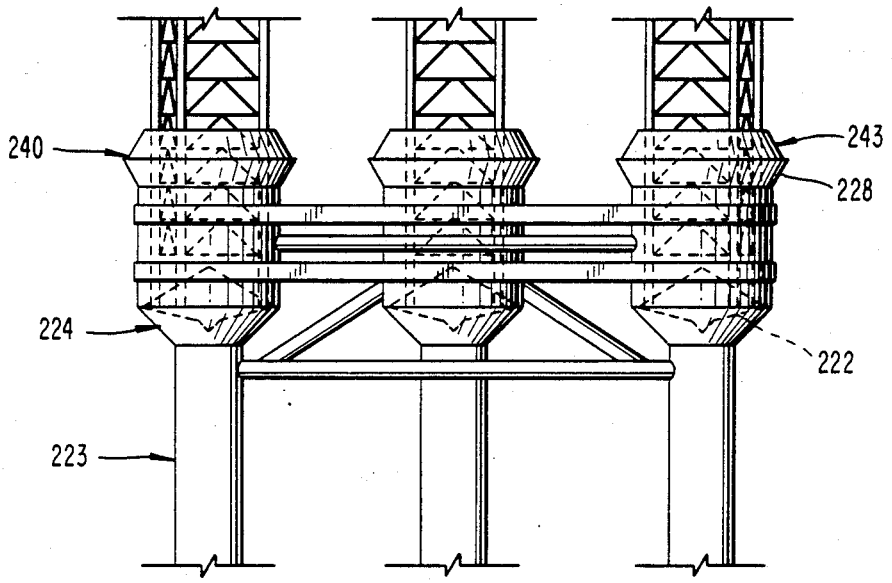
FIG. 4 shows a side elevation of the stop assembly shown in FIG. 2 applied to a support tower having three receptacles.
Figure 6:
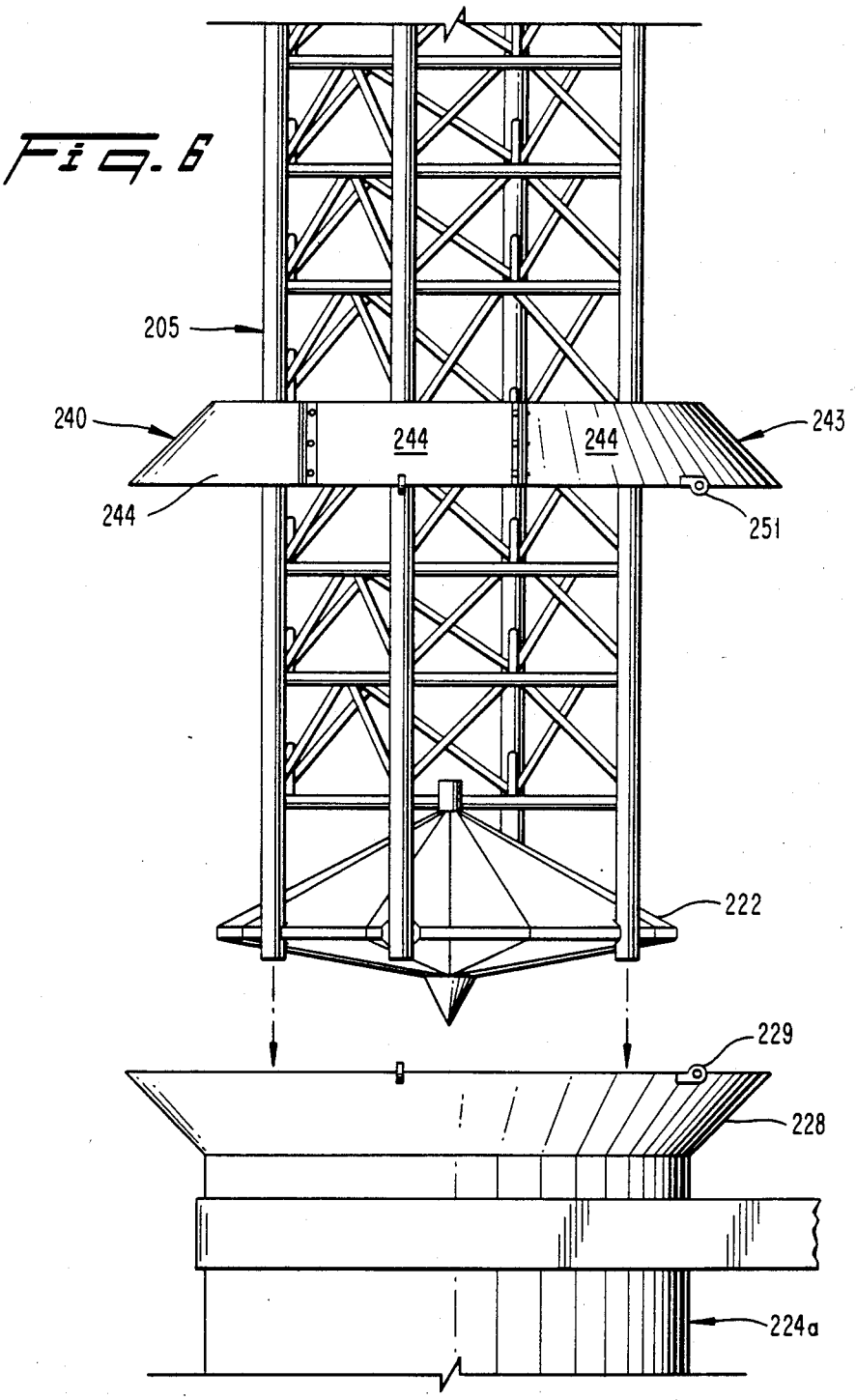
FIGS. 6–8 show side elevations of the three support legs shown in FIG. 4 prior to insertion in their respective receptacles.

As shown in FIG. 4, an outer wall 228 of an upper end of each receptacle 224 extends radially upwardly and outwardly from a column of the support assembly 223 and the stationary part of the stop assembly 240 comprises a cover 243 removably fitted over the outer wall 228 of a respective receptacle 224. The cover 243 has a flat upper surface and the side surface extends radially downwardly and outwardly to provide the dual purpose of engaging the receptacle when the support leg adapter 222 penetrates a predetermined distance into the receptacle 224 and prevents the undesired removal of grouting material or mud which is pumped into the receptacle to anchor the support leg in the receptacle. As shown in FIG. 6, the cover 243 can comprise sections 244 removably fitted together to form a collar extending around the support leg, for instance, the sections 244 including radially outwardly extending flanges which are bolted together.

The securing means 250 can comprise at least one part 251 on the stop assembly 240, the part 251 having an opening therethrough and at least one member 229 on the receptacle, the member 229 also having an opening therethrough which is aligned with the opening in the part 251 when the stop assembly is engaged with the receptacle. The securing means 250 can also include pin means 252 fitted into the opening of the part 251 and the opening of the member 229 for securing the stop assembly 240 to the receptacle 224.

Figure 5:
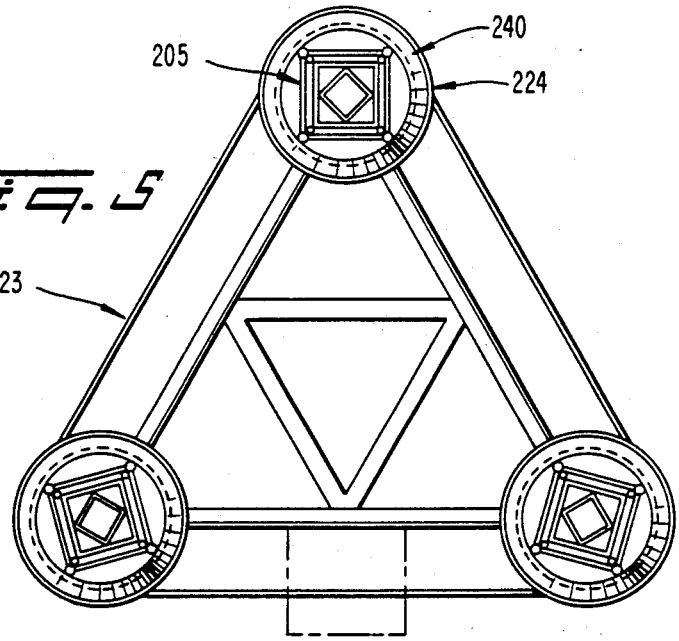
FIG. 5 is a top view of the arrangement shown in FIG. 4.
Figure 7:
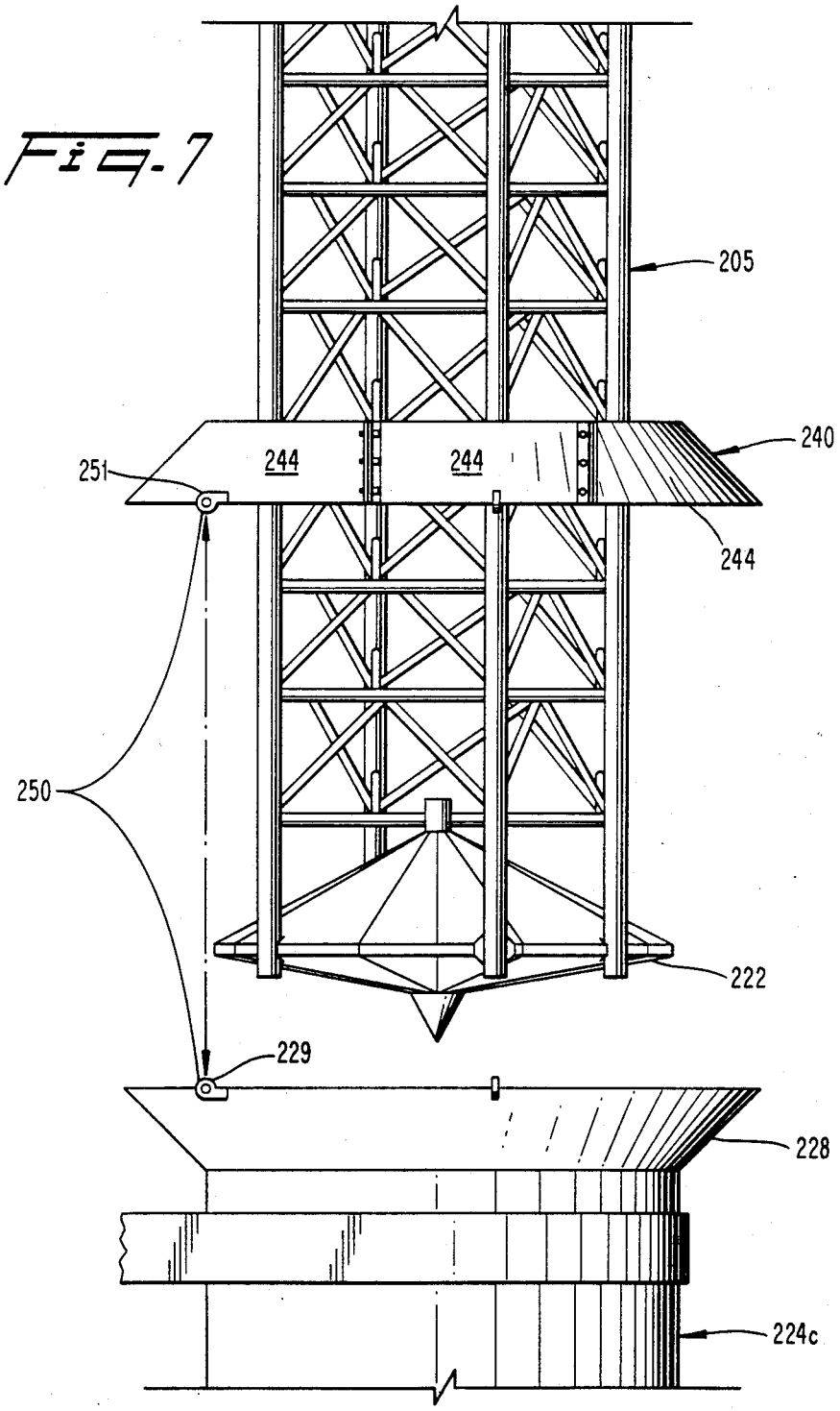
Figure 8:
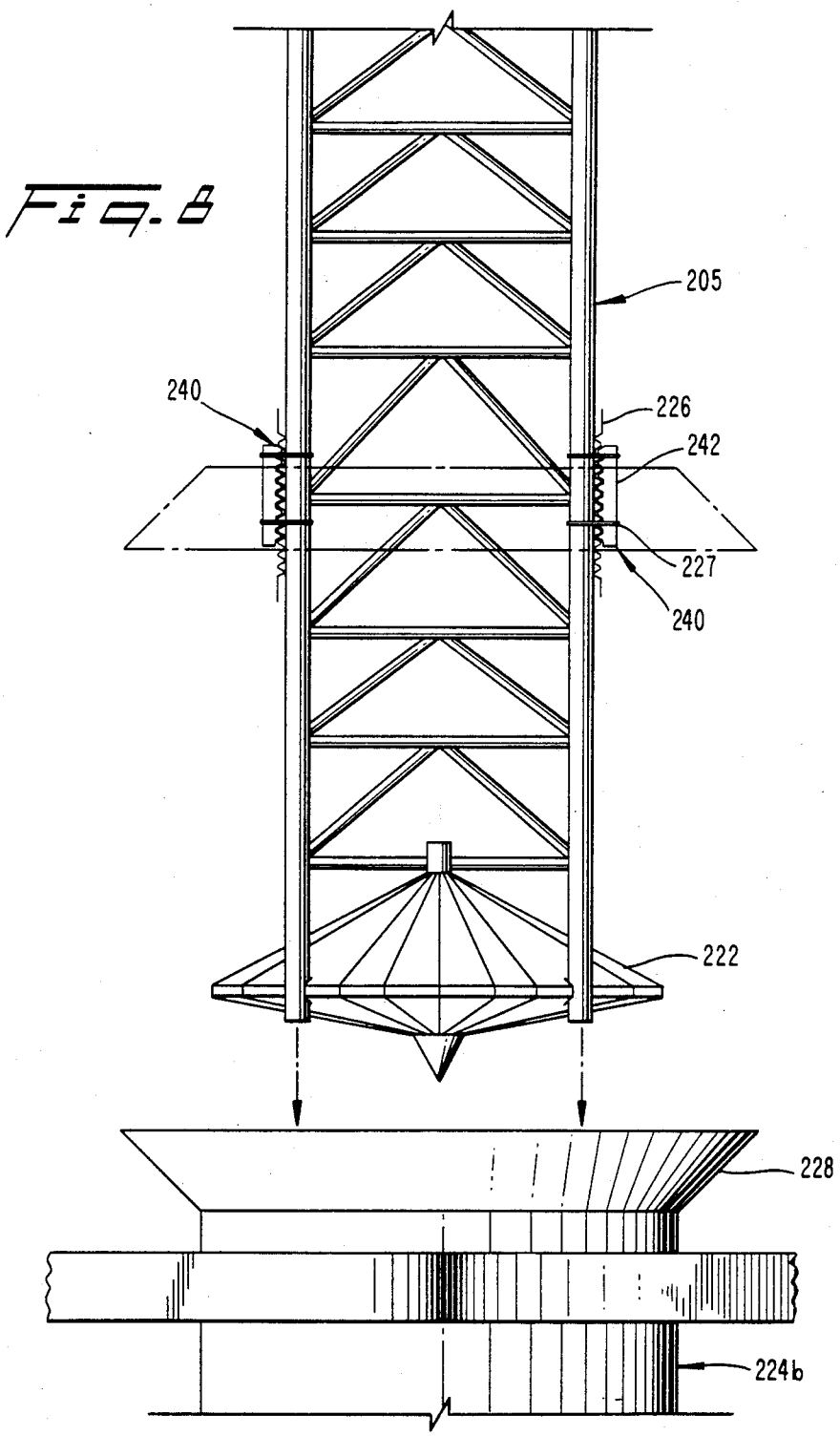

FIGS. 6–8 show a support assembly 223 having three receptacles 224*a*, 224*b*, 224*c* and how the support legs 205 of a jack-up platform assembly are aligned with the respective receptacles and secured thereto with a stop assembly 240 mounted on each of the support legs 205. Accordingly, by placing the stop assembly racks 242 at predetermined positions along the support legs 205, the cover 243 of the stop assembly 240 engages the receptacle 224 when the support leg adapter 222 penetrates a predetermined distance into the receptacle 224. A top view of this arrangement is shown in FIG. 5.

Figures 9, 10, 11:
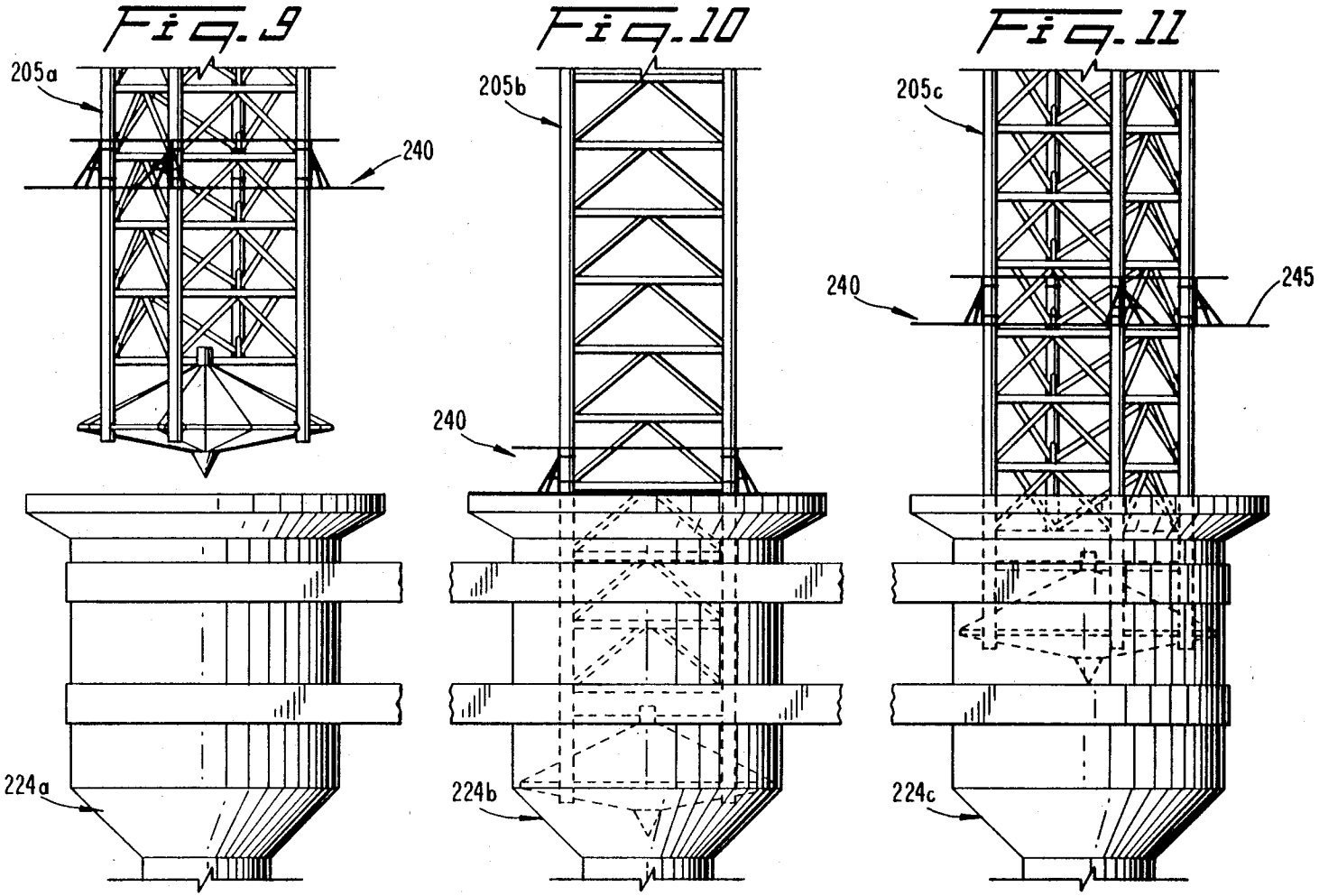
FIGS. 9–11 show a second embodiment of the stop assembly according to the invention wherein three legs of a platform are shown prior to insertion, fully inserted and partially inserted, respectively, in the tower support receptacles.

A second embodiment of the invention will now be described with reference to FIGS. 9–16. In the second embodiment, the stationary part of the stop assembly 240 comprises a base 245 fitted over the upper end of the receptacle 224, the base including at least one opening 246 cooperating with the securing means 250 to secure the stop assembly 240 to the receptacle 224. FIGS. 9–11 show how the stop assembly 240 of the second embodiment cooperates with the three support legs 205*a*, 205*b*, 205*c* and the receptacles 224*a*, 224*b*, 224*c* of a support assembly 220.

Figure 12:
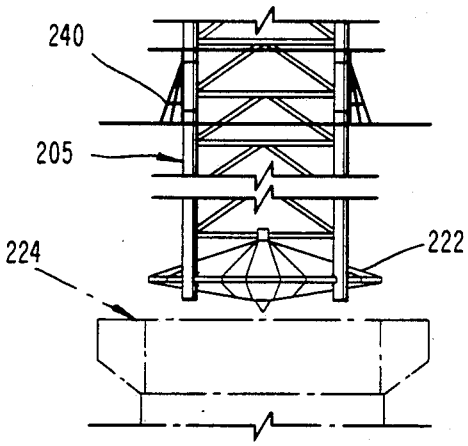
FIG. 12 is a side elevation of the stop assembly according to the second embodiment.
Figure 13:
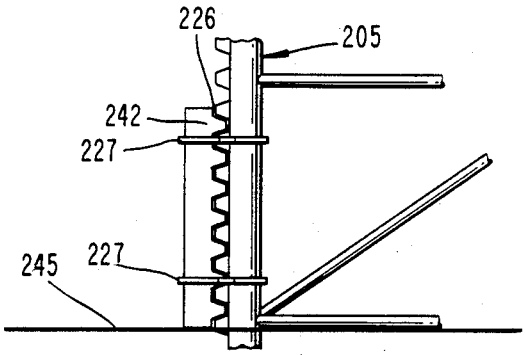
FIG. 13 is a side elevation view showing the rack of the stop assembly engaged with the rack of a support leg.
Figure 14:
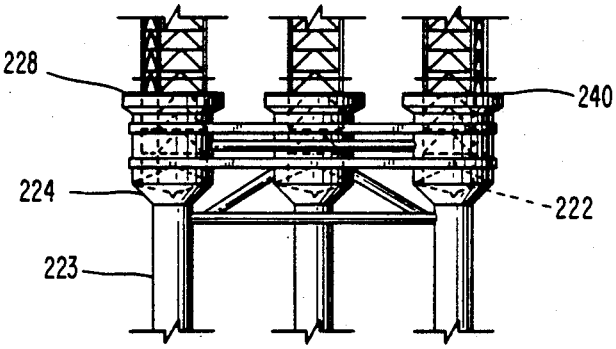
FIG. 14 is a side elevation view showing the stop assembly according to the second embodiment engaging three legs of a support platform with three receptacles of a support tower.

As in the first embodiment, a rack 226 is provided along the corner of a support leg 205 and the stop assembly 240 includes a rack 242 engaged with the support leg rack and clamping means 227 is provided for the clamping the stop assembly rack 242 to the support leg rack 226, as shown in FIG. 13. The base 245 is fixed to the stop assembly rack 242 whereby when the stop assembly 240 is attached to a support leg 205 at a predetermined location (as shown in FIG. 12), the stationary base 245 of the stop assembly 240 mechanically engages a portion of the receptacle 224 when the support leg adapter 222 penetrates a predetermined distance into the receptacle 224, as shown in FIG. 14.

Figure 15:
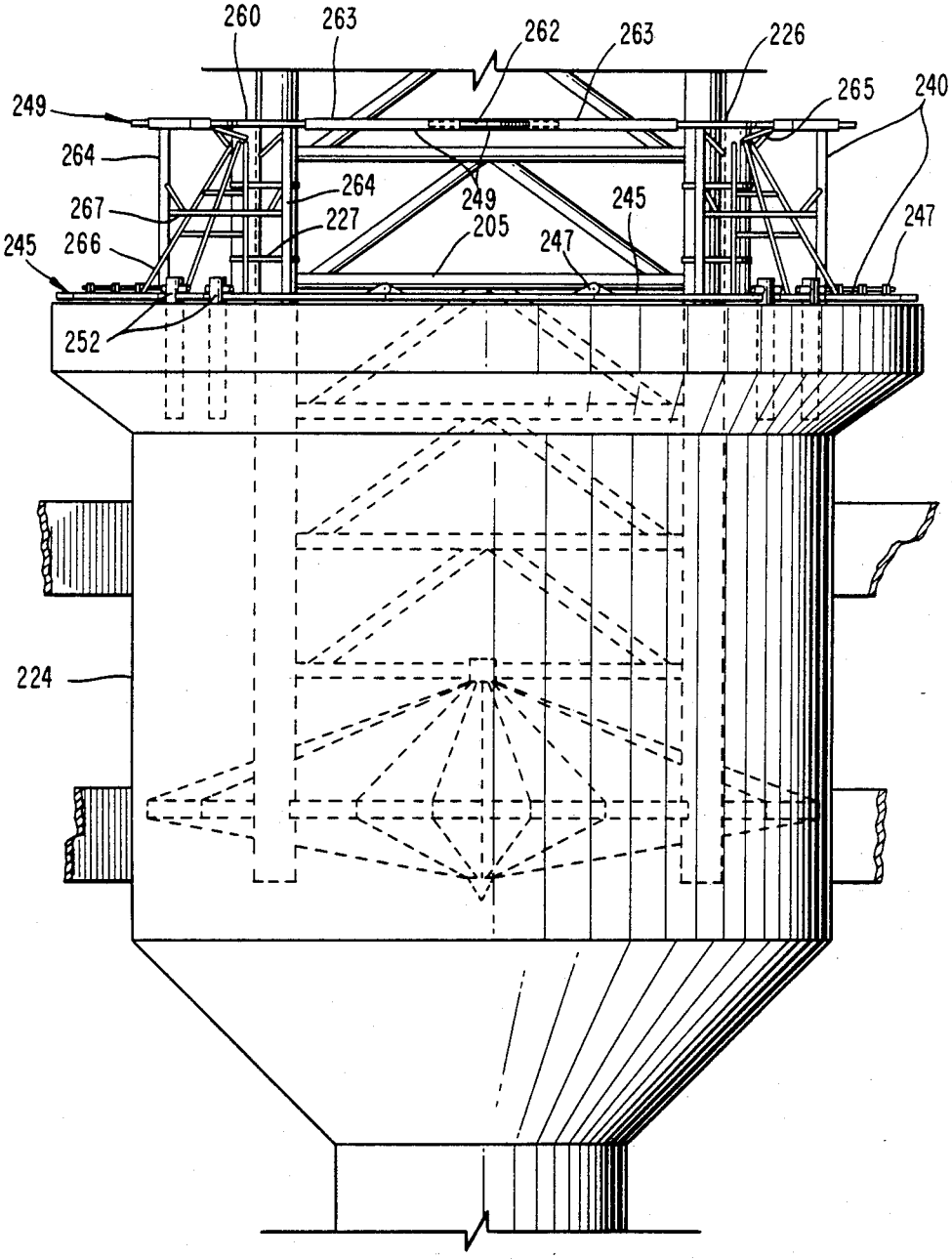
FIG. 15 is a side elevation view of the stop assembly according to the second embodiment.
Figure 16:
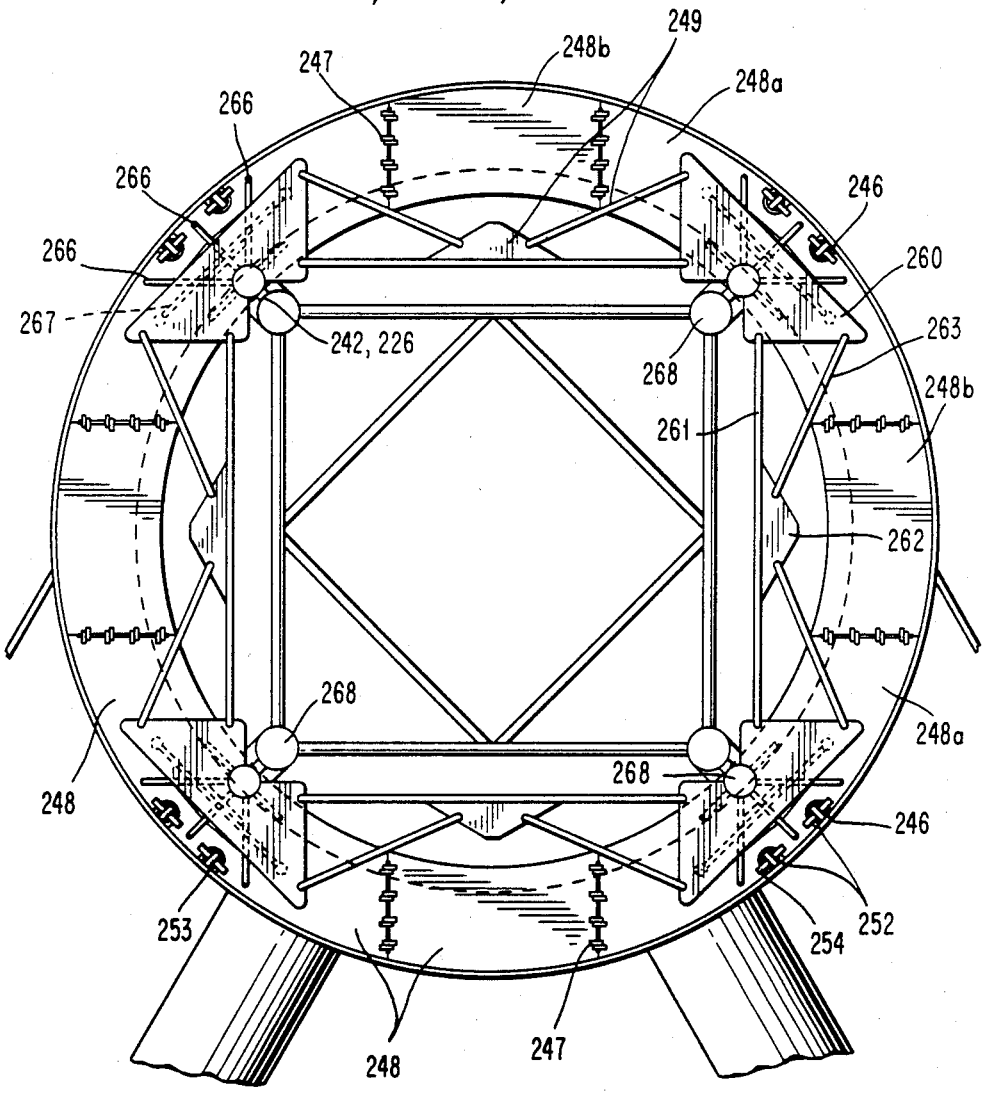
FIG. 16 is a top view of the stop assembly according to the second embodiment.

FIGS. 15 and 16 show more details of the stop assembly 240 according to the second embodiment. In particular, the base 245 includes at least one opening 246 cooperating with the securing means 250 to secure the stop assembly 240 to the receptacle 224. The at least one opening 246 can comprise a plurality of openings circumferentially spaced apart around the base 245 as shown in FIG. 16. The securing means 250 can include a plurality of projections 252 (as shown in FIG. 15) extending vertically upward from the receptacle 224 and received within the openings 246 when the stop assembly is engaged with the receptacle. To secure the stop assembly 240 to the receptacle 224, the projections 252 include horizontally extending openings 253 therein and the securing means 250 further includes pins 254 inserted in the openings 253 for securing the base between the pins 254 and the upper end of the receptacle 224.

Similar to the cover 243 of the first embodiment, the base 245 of the second embodiment can be provided in a plurality of sections 248 removably fitted together. In particular, the sections 248 can be fitted together by hinged connection means for securing the sections together.

The stop assembly 240 according to the second embodiment can include a framework 249 connected to the base 245, the framework 249 including a plurality of vertically extending posts 268, each of the posts 268 being adjacent a respective corner of the support leg 205, the stop assembly racks 242 extending along each of the posts 268. The framework 249 includes corner pieces 260, each of which is supported on an upper end of a respective one of the posts 268 and horizontally extending connectors 261, 262, 263, each of which is removably attached to two of the corner pieces 260.

The connectors comprise a longitudinal member 261 extending between two of the corner pieces 260 and a pair of angled members 263, each of which has one end thereof removably fixed to a central part 262 of the longitudinal member. An opposite end of the angled members 263 is removably fixed to a respective one of the corner pieces 260 such that an acute angle is formed between the longitudinal member 261 and each of the angled members 263.

The framework 249 also includes a plurality of first braces 266 extending between each of the posts 268 and the base 245. In addition, a plurality of vertically extending members 264 extends between each of the corner pieces 260 and the base 245 with at least one horizontal brace 267 extending between the vertically extending members 264 and a plurality of second braces 265 extends between each of the corner pieces 260 and a respective one of the posts 268. The framework thus provides a rigid interconnecting structure between the multi-piece base 245 and the stop assembly racks 242.

Of course, many framework designs could be incorporated in the stop assembly of the present invention. For instance, when the support leg 205 includes four corners, the base 245 can comprise eight sections 248, four of the sections being interchangeable corner sections **248*a*, each of the corner sections 248*a* being disposed at a respective one of the corners of the support leg 205, and another four of the sections 248 being interchangeable connecting sections 248*b*, each of the connecting sections 248*b* joining together two of the corner sections 248*a***.

As shown in FIG. 16, joints between the corner sections **248*a* and the connecting sections 248*b* on opposite sides of the support leg are parallel to each other. Furthermore, each of the corner sections 248*a* can have a first edge joined to one of the connecting sections 248*b* and a second edge joined to another one of the connecting sections 248*b*** such that the first edge extends in a direction which is perpendicular to the direction in which the second edge extends.

It is, of course, possible to embody the invention in other specific forms than those of the preferred embodiments described above. This may be done without departing from the essence of the invention. The preferred embodiments are merely illustrative and should not be considered restrictive in any way. The scope of the invention is defined by the appended claims rather than the preceding description and all variations, substitutions and equivalents which fall within the spirit and scope of the claims are intended to be embraced therein.

What is claimed is:

1. A marine structure comprising:

a jack-up platform assembly having a platform and at least three support legs, each leg having a generally cylindrical adapter at a lower end thereof;

a support assembly including a receptacle for each of said support legs, said receptacle mating with said support leg adapter and supporting said platform assembly enabling said platform to be jacked above an ocean surface;

anchoring means for anchoring said support assembly at a desired location so that said receptacle is at a fixed height above an ocean floor;

a stop assembly removably attached to each of said support legs, said stop assembly being spaced from said support leg adapter and including a stationary part which mechanically engages a portion of said receptacle when said support leg adapter penetrates a predetermined distance into said receptacle; and securing means for securing said stop assembly to said receptacle.

2. The structure of claim 1, wherein each of said support legs includes at least one projection along an outer periphery thereof and said stop assembly includes at least one projection engaged with said projection of a respective one of said support legs.

3. The structure of claim 2, wherein said at least one projection of said support leg comprises teeth of a rack and said at least one projection of said stop assembly comprises teeth of a rack interlocking with said teeth of said support leg rack.

4. The structure of claim 3, wherein said stop assembly includes clamping means for clamping said stop assembly rack to said support leg rack.

5. The structure of claim 1, wherein an outer wall of an upper end of said receptacle extends radially upwardly and outwardly and said stationary part of said stop assembly comprises a cover removably fitted over said outer wall of said receptacle.

6. The structure of claim 5, wherein said cover comprises sections removably fitted together.

7. The structure of claim 1, wherein said securing means comprises at least one part having an opening therethrough on said stop assembly, at least one member on said receptacle having an opening therethrough aligned with said opening in said part when said stop assembly is engaged with said receptacle, and pin means fitted in said opening of said part and said opening of said member for securing said stop assembly to said receptacle.

8. The structure of claim 1, wherein said stationary part of said stop assembly comprises a base fitted over an upper end of said receptacle, said base including at least one opening cooperating with said securing means to secure said stop assembly to said receptacle.

9. The structure of claim 8, wherein said at least one opening comprises a plurality of openings circumferentially spaced apart around said base, said securing means including a plurality of projections extending from said receptacle and received within said openings when said stop assembly is engaged with said receptacle.

10. The structure of claim 9, wherein said projections include openings therein and said securing means further includes pins inserted in said openings for securing said base between said pins and said upper end of said receptacle.

11. The structure of claim 8, wherein said base comprises a plurality of sections removably fitted together.

12. The structure of claim 11, wherein said sections are fitted together by hinged connection means.

13. The structure of claim 8, wherein said stop assembly includes a framework connected to said base, said framework including a plurality of vertically extending posts, each of said posts being adjacent a respective corner of said support leg, said support leg including racks, each of which extends along a respective corner of said support leg, said stop assembly including racks, each of which extends along a respective one of said posts and engages a respective one of said racks of said support leg.

14. The structure of claim 13, wherein said framework includes corner pieces, each of said corner pieces being supported on an upper end of a respective one of said posts and said framework includes horizontally extending connectors, each of said connectors being removably attached to two of said corner pieces.

15. The structure of claim 14, wherein each of said connectors comprises a longitudinal member extending between two of said corner pieces and a pair of angled members, each of said angled members having one end thereof removably fixed to a central part of said longitudinal member and an opposite end thereof removably fixed to a respective one of said corner pieces such that an acute angle is formed between said longitudinal member and each of said angled members.

16. The structure of claim 14, wherein said framework includes a plurality of first braces extending between each of said posts and said base, a plurality of vertically extending members extending between each of said corner pieces and said base, at least one horizontal brace extending between said vertically extending members, and a plurality of second braces extending between each of said corner pieces and a respective one of said posts.

17. The structure of claim 4, wherein said clamping means comprises a plurality of bands extending around said rack of said leg and said rack of said stop assembly, each of said bands being removably fixed together by bolt means.

18. The structure of claim 11, wherein said support leg includes four corners and said base comprises eight sections, four of said sections being interchangeable corner sections, each of said corner sections being disposed at a respective one of said corners of said support leg, another four of said sections being interchangeable connecting sections, each of said connecting sections being between two of said corner sections.

19. The structure of claim 18, wherein joints between said corner sections and said connecting sections on opposite sides of said support leg are parallel to each other.

20. The structure of claim 18, wherein each of said corner sections has a first edge joined to one of said connecting sections and a second edge joined to another one of said connecting sections, said first edge extending in a direction which is perpendicular to a direction in which said second edge extends.

* * * * *